US010246902B2

(12) United States Patent
Bastianini

(10) Patent No.: US 10,246,902 B2
(45) Date of Patent: Apr. 2, 2019

(54) LOCK DEVICE BASED ON A MECHANICALLY RE-PROGRAMMABLE DISC-TYPE DEVICE AND KEY FOR THE SAME

(71) Applicant: VIRO S.p.A., Zola Predosa (Bologna) (IT)

(72) Inventor: Filippo Bastianini, Bologna (IT)

(73) Assignee: VIRO S.P.A., Zola Predosa (Bologna) (IT)

( * ) Notice: Subject to any disclaimer, the term of this patent is extended or adjusted under 35 U.S.C. 154(b) by 384 days.

(21) Appl. No.: 14/443,295

(22) PCT Filed: Dec. 5, 2013

(86) PCT No.: PCT/IT2013/000338
§ 371 (c)(1),
(2) Date: May 15, 2015

(87) PCT Pub. No.: WO2014/091511
PCT Pub. Date: Jun. 19, 2014

(65) Prior Publication Data

US 2015/0292238 A1 Oct. 15, 2015

(30) Foreign Application Priority Data

Dec. 10, 2012 (IT) ..... BO2012A0662

(51) Int. Cl.
*E05B 29/00* (2006.01)
*E05B 35/00* (2006.01)
*E05B 27/00* (2006.01)

(52) U.S. Cl.
CPC ..... *E05B 27/005* (2013.01); *E05B 27/0007* (2013.01); *E05B 27/0014* (2013.01);
(Continued)

(58) Field of Classification Search
CPC ..... E05B 27/005; E05B 27/0007; E05B 27/0014; E05B 35/003; E05B 29/0013; E05B 29/004; E05B 29/002
(Continued)

(56) References Cited

U.S. PATENT DOCUMENTS 1,567,979 A 12/1925 Northrup
4,377,082 A 3/1983 Wolter
(Continued)

FOREIGN PATENT DOCUMENTS

CA 1153903 9/1983
CA 2661241 A1 10/2009
(Continued)

OTHER PUBLICATIONS

International Search Report dated May 12, 2014 for related PCT Application No. PCT/IT2013/000338.

*Primary Examiner* — Lloyd A Gall
(74) *Attorney, Agent, or Firm* — Shuttleworth & Ingersoll, PLC; Timothy Klima

(57) ABSTRACT

A cylinder and key lock mechanism is unlocked when a specific combination of rotation angles of dialer groups, each constituted by one internal dialer disc and by one external dialer ring coupled through teeth, is dialed through rotation of the key having a formed cipher. A security mechanism, being part of the key and driven by the insertion of the key into the cylinder, enables re-programming. When unlocked and with re-programming enabled, re-programming is possible where the inner dialer discs are decoupled from the respective outer dialer rings, the key can be rotated driving only the inner dialer discs and extracted leaving the system in a re-programming configuration. A new key having a different cipher can be inserted and the system exited re-programming with a different coupling between
(Continued)

the inner dialer discs and the respective outer dialer rings so that they couple with the new key cipher.

17 Claims, 4 Drawing Sheets

(52) U.S. Cl.
CPC ..... *E05B 29/004* (2013.01); *E05B 29/0013* (2013.01); *E05B 35/003* (2013.01)

(58) Field of Classification Search
USPC ..... 70/365, 366, 382–384, 398, 399, 409
See application file for complete search history.

(56) References Cited

U.S. PATENT DOCUMENTS

| | | | | |
|---|---|---|---|---|
| 4,942,749 | A | 7/1990 | Rabinow | |
| 5,613,389 | A * | 3/1997 | Hauser | E05B 29/0013 70/366 |
| 6,119,495 | A | 9/2000 | Loreit | |
| 6,553,801 | B2 * | 4/2003 | Chen | E05B 21/066 70/365 |
| 6,826,936 | B1 * | 12/2004 | Ming-Er | E05B 29/0013 70/353 |
| 6,880,376 | B1 * | 4/2005 | Ko | E05B 29/0013 70/366 |
| 7,340,929 | B1 | 3/2008 | Christopoulos | |
| 7,937,976 | B2 | 5/2011 | Huang et al. | |
| 8,074,480 | B2 | 12/2011 | Huang et al. | |
| 8,161,783 | B2 | 4/2012 | Huang et al. | |
| 2003/0019263 | A1 * | 1/2003 | Chen | E05B 21/066 70/366 |
| 2003/0041630 | A1 | 3/2003 | Laitala et al. | |
| 2003/0084692 | A1 | 5/2003 | Herdman | |
| 2003/0159483 | A1 | 8/2003 | Kondratuk et al. | |
| 2005/0172687 | A1 | 8/2005 | Segien et al. | |
| 2006/0101880 | A1 | 5/2006 | Ward-Dolkas et al. | |
| 2006/0112748 | A1 | 6/2006 | Benstead | |
| 2008/0307841 | A1 | 12/2008 | Huang et al. | |
| 2009/0277234 | A1 | 11/2009 | Huang et al. | |
| 2009/0277240 | A1 | 11/2009 | Huang et al. | |
| 2010/0018267 | A1 | 1/2010 | Huang et al. | |
| 2010/0050717 | A1 | 3/2010 | Chiang et al. | |
| 2010/0101288 | A1 | 4/2010 | Huang et al. | |
| 2010/0101289 | A1 | 4/2010 | Huang et al. | |
| 2011/0041577 | A1 | 2/2011 | Zhang | |
| 2011/0154872 | A1 | 6/2011 | Huang et al. | |

FOREIGN PATENT DOCUMENTS

| | | | |
|---|---|---|---|
| DE | 3542008 | | 6/1987 |
| DE | 3709417 | | 10/1988 |
| DE | 3711935 | | 10/1988 |
| DE | 102004045792 | | 4/2006 |
| EP | 210037 | | 1/1987 |
| EP | 622508 | | 11/1994 |
| EP | 890694 | | 1/1999 |
| EP | 1470307 | | 10/2004 |
| EP | 1726749 | | 11/2006 |
| ES | 294528 | | 1/1987 |
| ES | 2196492 | | 12/2003 |
| TW | 200944643 | | 11/2009 |
| TW | 200946757 | | 11/2009 |
| TW | 200951282 | | 12/2009 |
| TW | 201009175 | | 3/2010 |
| TW | 201009176 | | 3/2010 |
| TW | 201028520 | | 8/2010 |
| TW | 201028522 | | 8/2010 |
| TW | 201118227 | | 6/2011 |
| TW | 201135039 | | 10/2011 |
| TW | I361244 | | 4/2012 |
| WO | 9840589 | | 9/1998 |
| WO | 9964703 | | 12/1999 |
| WO | 2003064795 | | 8/2003 |
| WO | WO2004079134 | A1 | 9/2004 |
| WO | WO2004079135 | A1 | 9/2004 |
| WO | WO2006055281 | A2 | 5/2006 |
| WO | WO2009008852 | A1 | 1/2009 |
| WO | 2009151464 | | 12/2009 |
| WO | WO2011088861 | A1 | 7/2011 |
| WO | 2011091832 | | 8/2011 |
| WO | WO2011098109 | A1 | 8/2011 |
| WO | 2011134610 | | 11/2011 |
| WO | WO2012021384 | A1 | 2/2012 |
| WO | 2012135398 | | 10/2012 |

* cited by examiner

LOCK DEVICE BASED ON A MECHANICALLY RE-PROGRAMMABLE DISC-TYPE DEVICE AND KEY FOR THE SAME

This application is the National Phase of International Application PCT/IT2013/000338 filed Dec. 5, 2013 which designated the U.S. and that International Application was published under PCT Article 21(2) in English.

This application claims priority to Italian Patent Application No. BO2012A000662 filed Dec. 10, 2012, which application is incorporated by reference herein.

TECHNICAL FIELD OF THE INVENTION

The present invention concerns a cylinder type lock having a mechanically re-programmable rotating disk type mechanism and a key for the same.

BACKGROUND ART

A number of re-programmable cylinder type lock devices are known based on a piston/counter-piston mechanism that can be reprogrammed through a mechanism able to change the equivalent length of the elements that act as pistons to learn the cipher of a new key inserted into the cylinder when this is in a condition where all the elements acting as pistons have been preventively decoupled one with respect to another by a suitable procedure.

As an example, see the following patents and patents applications U.S. Pat. Nos. 6,119,495A, 7,340,929B1, US2003041630A1, WO9840589A1, WO2011091832A1, WO2011098109A1, WO2011134610A1, TW200951282A, TW201009175A, TW201009176A, US2006112748A1, WO2004079134A1, WO2004079135A1, EP0210037A3, TW200944643A, TW200946757A, TW201028520A, TW201028522A, TW201118227A, TW201135039A, TWI361244B, U.S. Pat. Nos. 7,937,976B2, 8,074,480B2, US2003159483A1, US2005172687A1, US2009277234A1, US2009277240A1, US2010018267A1, US2010050717A1, US2010101288A1, US2011041577A1, WO2006055281A2, WO2009008852A8, WO2012135398A1. To be considered of special relevance, are some solutions in which the elements that act as pistons can be decoupled one with respect to another by a respective translation along the axis of the cylinder, as disclosed in the patents and patent applications US2008307841A1, US2010101289A1, US2011154872A1, WO2009151464A1, WO2011088861A1, WO2012021384A1.

All the known solutions of re-programmable cylinder lock are characterized by a number of limitations concerning:

- a low resistance against the picking techniques according to the "bumping" method that are applicable to the systems in which the mechanism comprises a contrast spring such as in the known piston/counter-piston mechanisms;
- a low level of security against unauthorized re-programming, since the re-programming procedure is easily accessible or, even in case it requires a special key, such a key can be easily obtained starting from one of the conventional access keys modifying it in an easy way;
- a low level of security against the unauthorized duplication of the keys, and in particular of that of the type capable to enable the re-programming procedure, since they are characterized by keys that are constituted by simple elements not having moving mechanisms.

There are known many systems of cylinder-type locks comprising a disk-type mechanism in which the unlocking of the lock is obtained when a specific combination of the angle of rotation of the disk elements driven by the rotation of the key on the lateral surface of which is obtained a suitable cipher by means of millings, such as for example in patent application EP0622508A1. These systems cannot be re-programmed without changing or modifying their own components and furthermore they have a low level of security against the unauthorized duplication of the keys since they couple with keys that are constituted by simple elements without moving mechanisms.

Also known are many non-reprogrammable cylinder type locks that are characterize by a high level of security against the unauthorized duplication of the keys; these types of non-reprogrammable cylinder type locks are coupled with keys that comprise moving mechanisms like those described in the patents or patent applications CA1153903A1, DE3542008A1, DE3709417A1, DE3711935A1, DE102004045792A1, EP0890694A1, EP1470307A1, EP1726749A2, ES294528U, ES2196492T3, U.S. Pat. Nos. 1,567,979A, 4,377,082A e WO03064795A1.

DISCLOSURE OF THE INVENTION

In a first broad independent aspect, the present invention provides a lock device capable of being reprogrammed an infinite number of times with a mechanical procedure that does not require the substitution, addition or the elimination of components, and that could be obtained by bringing the mechanical system into a re-programming status by the action of a key having the present unlocking cipher and a specific mechanism to activate the status, and successively by inserting one key having a new and different cipher and an analogous mechanism.

In a first subsidiary aspect, the present invention combines the re-programmable lock-key coupling with a lock/unlock mechanism that does not have either contrasting springs or gravity contrast with the scope of ensuring the intrinsic resistance to the picking techniques with the "bumping" method.

In a third subsidiary aspect, the present invention combines the lock mechanism with a key that comprises a complex mechanism with moving parts, at least for what concerns the control of the re-programming operation, so that to ensure a high level of security against the unauthorized re-programming and against the unauthorized duplication of the keys

BRIEF DESCRIPTION OF DRAWINGS

A full and enabling disclosure of the present invention, including the best mode thereof, directed to one of ordinary skill in the art, is set forth in this specification, which makes reference to the appended figures, in which.

DETAILED DESCRIPTION OF THE PREFERRED EMBODIMENTS

Selected combinations of aspects of the disclosed technology correspond to a plurality of different embodiments of the present invention. It should be noted that each of the exemplary embodiments presented and discussed herein should not insinuate limitations of the present subject matter. Features or steps described as part of one embodiment may be used in combination with aspects of another embodiment to yield yet further embodiments. Additionally, certain features may be interchanged with similar devices of features not expressly mentioned which perform the same or similar function.

Figure 1:
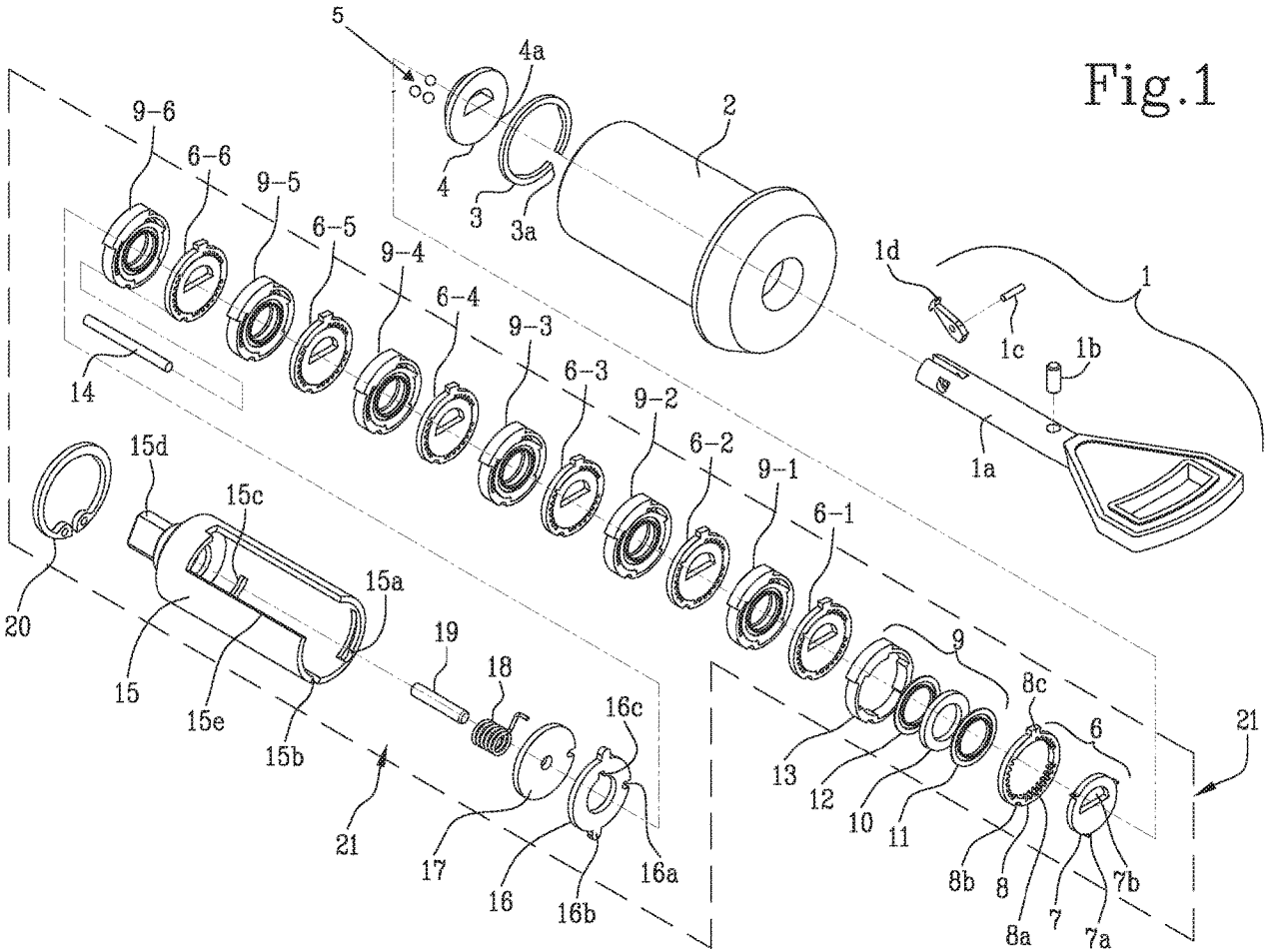
FIG. 1 illustrates an exploded view of one preferred embodiment, even if not binding, of the lock of the present disclosure.

In FIG. 1 is presented a preferred embodiment of the device of the present invention.

The device comprises at least one key (1) characterized by a body (1*a*) having a protruding member (axially extending portion) on the surface of which can be made a cipher, for example by means of removing material, and comprising at least one mechanism constituted by a moving element (1*d*), eventually connected to the same body (1) by means of at least one connecting member (1*c*), in which the said moving element (1*d*) can rotate with respect to the body (1).

The system comprises at least one stator body (2) having at least one cavity suitable to accept other internal components (from 3 to 19) of the lock among which at least one rotor body (15) is capable of driving, even if not directly, with a suitable part of mechanical coupling (15*d*) at least one element, for example one bolt, not necessarily being part of the same lock; the rotor body (15) being at least partially axially retained inside the stator by at least one fixing element (20).

The lock comprises furthermore at least one locking mechanism comprising a plurality of "dialer disk" groups (6 and from 6-1 to 6-6) each of which is constituted by at least one inner dialer disk (7) having at least one tooth (7*a*) and one opening (7*b*) suitable to couple with the prolonged protrusion of the body (1*a*) of the key (1), and at least one outer dialer ring (8) characterized by at least one indentation (8*b*) on the outer border and by a multiplicity of indentations (8*a*) each suitable to have a coupling with the tooth (7*a*) of the inner disk (7) with a different angle of rotation between the same and in a way that the disk (7) could drive jointly the rotation of the ring (8) under the action of the key (1) when the coupling (7*a*-8*a*) is active, and the outer dialer ring (8) eventually comprising also at least one tooth (8*c*) suitable to limit the possibility of rotation with respect to the rotor body (15) within limits imposed by the coupling between the tooth (8*c*) and a seat (15*e*) obtained in the rotor body (15).

Figure 2:
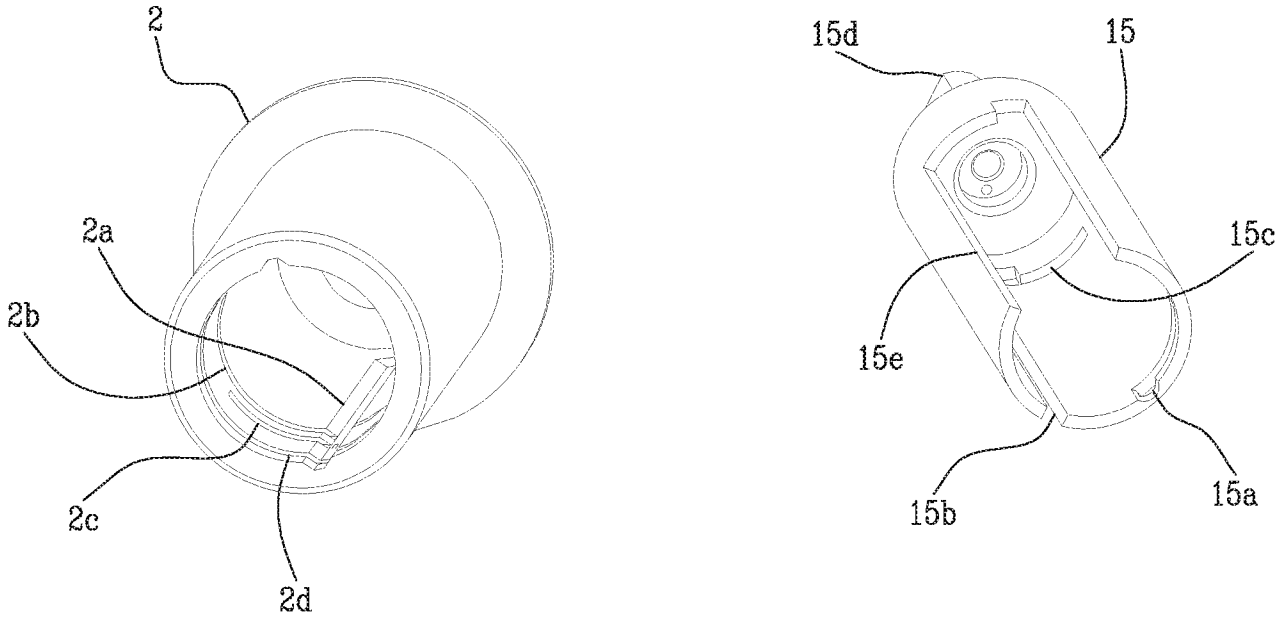
FIG. 2 illustrates some components of the lock of the same preferred embodiment of FIG. 1 shown from a different point of view with the scope of highlighting specific functional characteristics of same.

The locking mechanism comprises moreover a least one engagement element (14) partially housed in the seat (15*b*) obtained in the rotor body (15), that, in the status of "closed lock", is forced to stay partially also in a seat (FIG. 2) obtained in the body of the stator (2) to prevent rotation of the rotor (15) with respect to the stator (2); and the engagement element (14) in the status of "open lock" can leave the seat (2*a*) remaining in the outline of the rotor (15) and disengaging in this way its possibility of rotation with respect to the stator (2) when all the "dialer disk" groups (6 and from 6-1 to 6-6), under the drive of a partial rotation of the key (1) inserted inside the lock, are rotated in a way that aligns the indentations (8*b*) with seat (15*b*) and delivers in this way a slot sufficient for the complete inclusion of the engagement element (14) within the outline of the rotor group (21) defined at least by the rotor body (15) and by the elements defining the locking mechanism.

The lock comprises moreover at least one re-programming mechanism controlled by a specific action of the key (1) and configured for re-programming each "dialer disk" group (6 and from 6-1 to 6-6) in this way: the inner dialer disk (7) could be decoupled from its respective outer dialer ring (8) and, successively, the key (1), having a cipher provided by a sequence of indentations, could be extracted and substituted with one analogue new key having a different cipher provided by a different sequence of indentations and, by the action of this latter new key, each inner dialer disk (7) could be again coupled to its respective outer dialer ring (8) in a configuration between the tooth (7*a*) and one of the indentations (8*a*) characterized by an angle of rotation of the disk (7) and the dialer ring (8) that fits the cipher that characterizes the new key.

In the preferred embodiment depicted, not binding, the said re-programming mechanism comprises a multiplicity of "spacer disk" groups (9 and from 9-1 to 9-6) each of them adjacent to one of the "dialer disk" groups, each of them comprising at least one outer spacer ring (13) and one or more inner spacer disks (10, 11 and 12) suitably shaped and arranged in a way to allow that an axial translation of the pile (stack) of inner dialer disks (7) alternated to inner spacer disks (10, 11 and 12) moves each inner dialer disk (7) inside one adjacent outer spacer ring (13), in this way axially decoupling the inner dialer disk (7) from the respective outer dialer ring (8). In the preferred embodiment depicted, not binding, the translation is controlled by the axial thrust of the key (1), whereby a protrusion on the key, such as, for example pin (16), engages front disk (4) which is shaped to push on the pile of the inner dialer disks (7) and inner spacer disks (10, 11 and 12), against the counterforce of the axial thrust of a spring (18) acting on the opposite side of the pile through the shutter disk (17), a counterforce that is potentially capable of pushing the key in an opposite control stroke. Also, in the embodiment depicted, the position of decoupling between the dialer disks (7) and the outer dialer rings (8) reached through the axial translation of the dialer disks (7) with respect to the outer dialers rings (8) can be maintained when the rotor is driven in partial reverse rotation of the key (1), thanks to at least one tooth (4*a*) of the front disk (4) that, in the position in which the axial translation is allowed, enters and engages one track (15*a*) in the rotor body (15), the track (15*a*) shaped in a suitable way, so that the key (1), at the end of the partial reverse rotation, can be extracted from the lock device while leaving the system in the status of decoupling between the disks (7) and rings (8). With the key (1) extracted, a new key (1) characterized by the different cipher can be inserted into the lock device.

In the preferred embodiment depicted, not binding, the front disk (4) has furthermore at least one cavity (4*b*) (see FIG. 3) suitable to house at least one element (5), which may be in the form of a sphere, (See FIGS. 1 and 3) and made of a high hardness material with the aim of improving its resistance against drilling; and it is furthermore present one partial spacer ring (3) having one opening or indentation (3*a*) suitable to accept the tooth (4*a*) of the front disk (4) when it is not engaged in the track (15*a*), the spacer ring (3) having the function of keeping the alignment between the front disk (4) and the rotor and of allowing free rotation in the status, again with the aim of improving the resistance against drilling of the lock.

In the preferred embodiment depicted the "spacer disk" group comprises a plurality of inner spacer disks, and in particular, one main inner spacer disk (10) positioned between auxiliary inner spacer disks (11 and 12); the auxiliary inner spacer disks (11 and 12) are shaped in a way that do not have points of contacts on the external periphery of inner dialer disks (7) and outer dialer disks (8) placed between the said auxiliary disks (11 and 12), with the scope of avoiding, in the condition of decoupling between the inner dialer disks (7) and the respective outer dialer disks (8), the possibility of interference between the edges of the teeth (7*a*) and those of the indentations (8*a*). The auxiliary inner spacer disks (11 and 12) space the adjacent disks in a way that makes possible, in the axial translation that brings the decoupled configuration, a state reached in which the inner dialer disks (7) replace the main inner spacer disks (10) inside the spacer rings (13) while the positions formerly occupied by the same inner dialer disks (7) are occupied by main inner spacer disks (10) or, only for the first "dialer disk" group, by a portion of the front disk (4).

The lock furthermore comprises at least one security mechanism for the consent of the reprogramming controlled by the moving mechanism forming part of the key (1) and designed to allow that the mechanism of reprogramming can be successfully activated only in a mechanical state in which the condition of "open" of the locking mechanism and the enable condition of the consent to the reprogramming of the mechanism are simultaneously realized.

In the preferred embodiment depicted, not binding, the consent to the reprogramming mechanism comprises at least one disk of enabling of the consent to the reprogramming (16) shaped so as to offer no possibility of coupling with the body profile of the key (1*a*), but rather equipped with at least one tooth (16*b*) on the peripheral edge and with at least one indentation (16*c*) suitable to engage with the movable element (1*d*) forming part of the moving mechanism of the key (1) when said moving element (1*d*) is pushed to protrude outside the outline of the key body (1*a*) by the presence of a protrusion, such as the head of the pin (19), which, in the insertion stroke of the key (1), goes to engage the seat formed in the body of the key (1*a*) that was previously occupied by the mobile element (1*d*) that was there in order not to interfere with the profile of the openings (7*b*) of the inner dial disks (7) intended for the insertion of the key (1) itself. The disk enabling the consent to reprogramming (16) is driven in a rotation, eventually contrasted by a spring (18), by the moving element (1*d*) during the rotation of the key (1) intended to bring the "dial disk" groups (6 and from 6-1 to 6-6) to the "open" configuration of the locking mechanism and by the rotation reaches a specific position in which the teeth (16*b*) on the peripheral edge of the disk (16), which engage each in a suitably shaped opening (15*c*) on the wall of the rotor body (15), no longer find impediment to a possible axial translation of the disk (16) by the shape of the opening (15*c*).

In the preferred embodiment depicted, not binding, the achievement of the position of the teeth (16*b*) with respect to the opening (15*c*) is a necessary but not sufficient condition to ensure that the translation is actually possible because the same teeth (16*b*), the projection of which is such as to exceed the outline of the rotor body (15), are engaged inside a front circular track (FIG. 2, 2*b*) obtained on the surface of the cavity of the stator (2), a track that the teeth (16*b*) may leave to move into a different rear track (FIG. 2, 2*c*) obtained on the same surface at a different axial position when they are aligned with a longitudinal groove that connects the two tracks and that is displaced at an angle that can be reached by the teeth (16*b*) only with a rotation of the rotor assembly that is only possible when the locking mechanism is in the "open" state.

In the preferred embodiment depicted, non-binding, at least one of the longitudinal grooves which connect the different tracks (FIGS. 2, 2*b* and 2*c*) coincides with the seat (FIG. 2, 2*a*) on the stator for the engagement element (14), and also the rear track (FIG. 2, 2*c*) extends for a limited angle to consent to the reverse rotation of the key (1) suitable to bring the key to the position of extraction but leaving the lock in a stable configuration of reprogramming until the insertion of a new key (1) that can drive the programming mechanism from the "decoupled" configuration.

Figure 3:
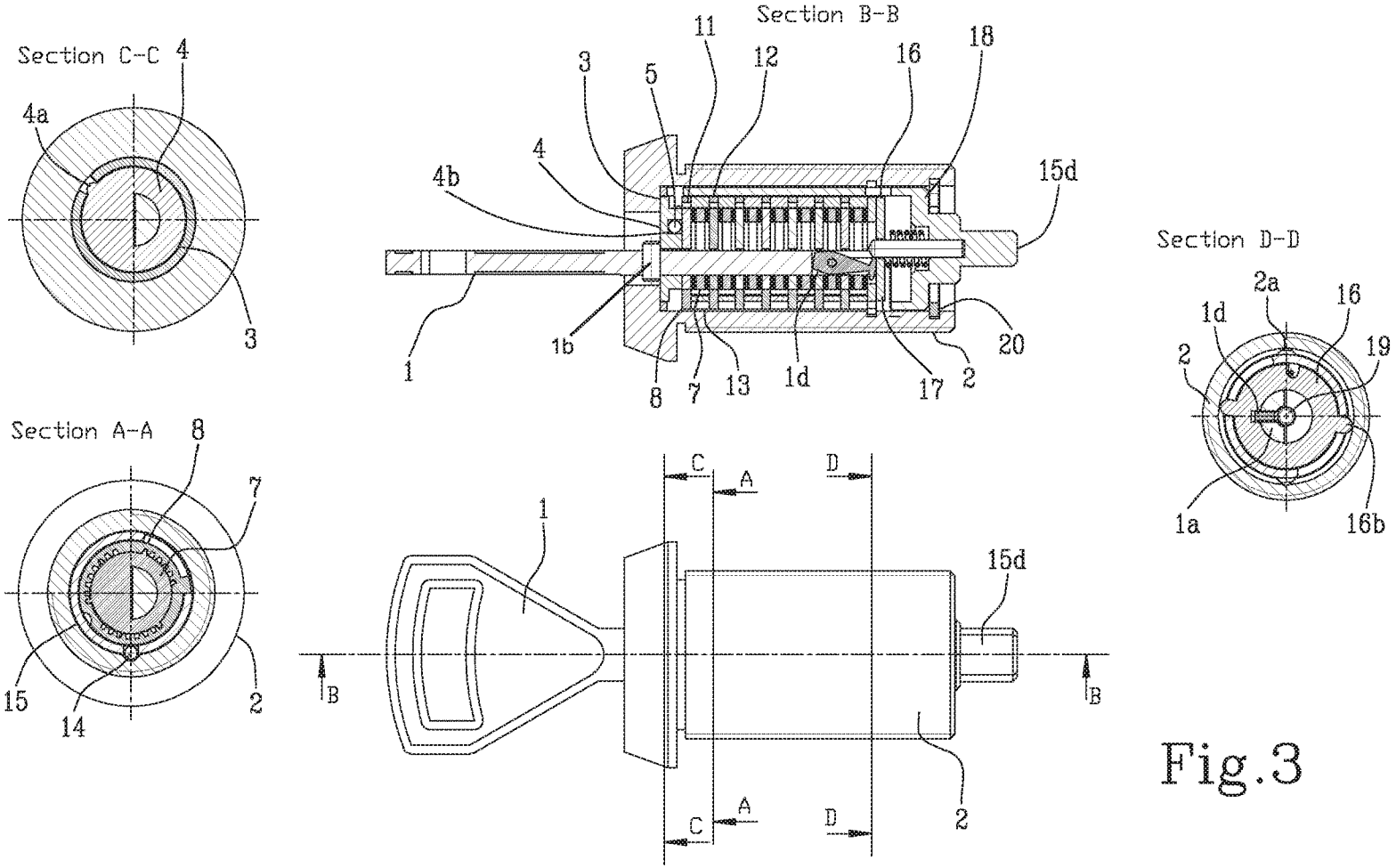
FIG. 3 illustrates some sectional views of the preferred embodiment already depicted in FIG. 1, shown in the configurations in which: the locking mechanism is in a "closed" state, the mechanism of reprogramming is in the inactive state, and the mechanism of consent to the reprogramming is in the disabled state.

FIG. 3 shows some sectional views of the preferred embodiment already depicted in FIG. 1, in a configuration in which:

- The locking mechanism is in the "closed" state, in which the relative rotation between the stator (2) and the rotor assembly is prevented due to the position assumed by the engagement element (14);
- The mechanism of reprogramming is in the inactive state, in which the inner dial disks (7) are coupled to the respective combiners external rings (8), and
- The mechanism of consent to the reprogramming is in the disabled state, in which the teeth (16*b*) of the disk (16) are not aligned with the grooves (2*a*).

Figure 4:
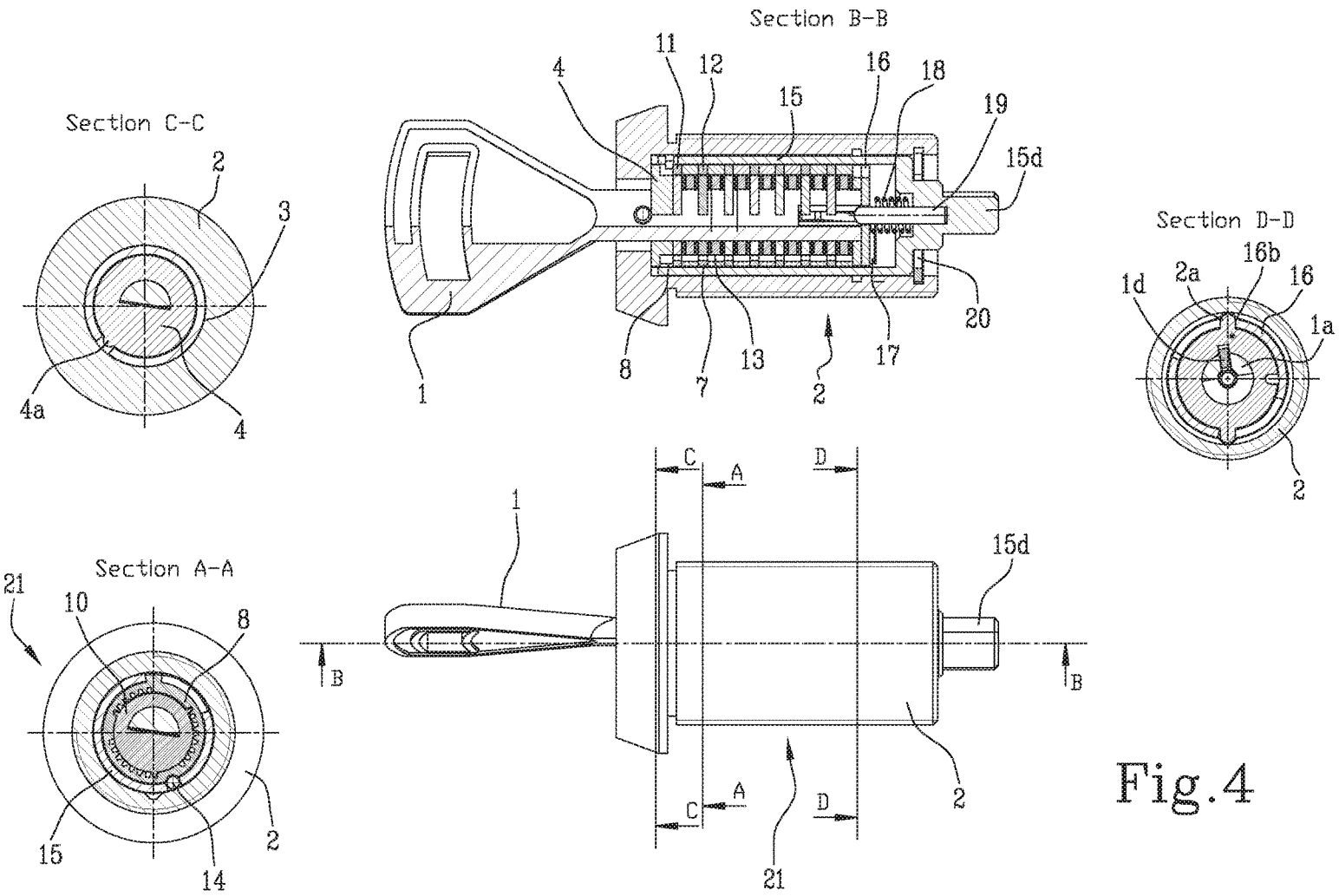
FIG. 4 illustrates some sectional views of the preferred embodiment already depicted in FIGS. 1 and 3, shown in the configuration in which: the locking mechanism is in the "open" state, the mechanism of reprogramming is in the active state, the mechanism of consent to the reprogramming is in the enabled state.

In FIG. 4 are shown some sectional views of the preferred embodiment already depicted in FIGS. 1 and 3, shown in the configuration in which:

- The locking mechanism is in the state of "open", in which the engagement element (14) is displaced within the outline of the rotor assembly,
- The mechanism of reprogramming is in the active state, in which the inner dial disks (7) are disengaged from the outer dial rings (8) and displaced in correspondence of the spacer rings (13), and
- The mechanism of consent to the reprogramming is in the enabled state, in which the teeth (16*b*) of the disk (16) are aligned with the grooves (2*a*).

In a second possible preferred embodiment (not shown), non-binding and partly referable to the one already described, are absent elements, such as the tooth (8*c*) of the rings (8), intended to limit the angle of rotation of the outer dial rings (8) with respect to the rotor body (15) and, in the condition of locking mechanism open, the dragging of the rotor assembly by the key (1) is obtained through the disk of enabling of the consent to the reprogramming (16).

In a further possible preferred embodiment (not shown), non-binding and partly referable to that described above, the dragging of the rotor assembly by the key (1) is obtained through a further dragging disk (not shown), similar to the disk of enabling of the consent to the reprogramming (16), but characterized by teeth (16*b*) suitable to act on the rotor body (15) without however exceeding the outline of the latter and therefore not capable of engaging the stator (2). Further, the keys (1) can be characterized by the kinds of mechanisms with a moving element (1*d*) different for engaging respectively whether only the driving disk, in case it is desired that the key could be used to open the lock but cannot be used to control its mechanism of reprogramming, or to engage instead, or possibly in addition, the disk of enabling of the consent to the reprogramming (16), in case it is desired that the key could be used both to open the lock and to control the mechanism of reprogramming.

Finally it is clear that modifications and variations can be made to the described device without leaving the scope of protection of the present invention.

What is claimed is:

1. A cylinder lock device, programmable an infinite number of times, comprising:

a key including a body having an axially extending portion with a surface including a sequence of indentations, the key comprising a mechanism having a moving member movable with respect to the body of the key;

a rotor including a body, a stator including a body having a cavity for housing, at least partially, other parts of the cylinder lock device;

a locking mechanism driven by a rotation of the key between a first "locked" configuration, in which free rotation of the rotor with respect to the stator is prevented, and a second "unlocked" configuration in which the rotor, driven by the rotation of the key, is freely rotatable, the locking mechanism comprising at least one dial member coupleable with at least part of the indentations on the key body, the at least one dial member comprising two sub-components;

a programming mechanism comprising the two sub-components of the at least one dial member coupleable reciprocally in a plurality of different positions, each of which realizes a different configuration of the at least one dial member that matches a specific type of indentation on the key body to be drivable between a first "coupled" configuration where the two sub-components of the at least one dial member are coupled reciprocally to allow a first one of the two sub-components coupled to the key body to drive a position of a second one of the two sub-components, and a second "decoupled" configuration where the two sub-components can change their position relative to one another to provide a different configuration of the at least one dial member; and a "programming mode enable" security mechanism comprising a programming mode enable disk engageable with and drivable only through the moving member and that allows activation of the programming mechanism only when, at the same time, the "programming mode enable" security mechanism is driven by the moving member of the key and the locking mechanism is in the "unlocked" configuration.

2. The cylinder lock device according to claim 1, wherein the at least one dial member comprises a plurality of dial members each comprising an inner dial disk that includes a tooth and an opening shaped to couple with the axially extending portion of the key body with the indentations, each of the plurality of dial members also comprising an outer dial ring including a first indentation on a peripheral edge and a plurality of other second indentations each for housing the tooth of the inner dial disk at a different reciprocal position between the dial disk and the dial ring, thus allowing a number of coupled configurations in which rotation of the inner dial disk driven by the key when coupled to the key body, drives rotation of the outer dial ring, the locking mechanism further comprising an engagement member, a seat in the rotor and a seat in the body of the stator, wherein, in the "locked" configuration, the engagement member is partially displaced inside the seat in the rotor and is partially displaced in the seat in the body of the stator so that rotation of the rotor with respect to the stator is prevented, and in the "unlocked" configuration, the engagement member can leave the seat in the body of the stator and displace itself inside the seat in the rotor to enable rotation of the rotor with respect to the stator, wherein the "unlocked" configuration is reachable when all the dial members are driven by a partial rotation of the key in a configuration where the first indentations are aligned with the seat in the rotor to provide space to accept the engagement member inside the seat in the rotor.

3. The cylinder lock device according to claim 2, wherein the programming mechanism comprises a plurality of spacer assemblies each adjacent to one of the plurality of dial members and each comprising an outer spacer ring and an inner spacer disk with a shape and an arrangement that allows an axial displacement of a stack of the inner dial disks, and the inner spacer disks can displace each inner dial disk inside one of the spacer rings, thereby decoupling the inner dial disk from its respective outer dial ring.

4. The cylinder lock device according to claim 3, and further comprising a pin on the axially extending portion of the key, a front disk positioned within the stator cavity and including a tooth, the front disk being shaped to engage the stack of inner dial disks, a spring acting on an opposite side of the stack, a shutter disk positioned between the spring and the stack, wherein the axial displacement of the stack of the inner dial disks and inner spacer disks is provided by an axial pushing action of the key, where the pin acts on the front disk so that the stack of inner dial disks is displaced axially by working against an axial reaction of the spring acting on the opposite side of the stack via the shutter disk, with the axial reaction of the spring being sufficient to drive an inverse axial displacement of the stack of inner dial disks when the axial pushing action of the key is removed, and wherein the "decoupled" configuration that is reached through the axial displacement is kept even when the axial pushing action of the key is removed after the rotor has been rotated in a direction of the "locked" configuration by a partial inverse rotation of the key due to an engagement of the tooth of the front disk with a track in the rotor reachable by the tooth of the front disk when in a position that allows the axial displacement, so that, at an end of the partial inverse rotation of the key, the key can be extracted from the lock leaving the lock in the "decoupled" configuration and ready to accept a new key including a different sequence of indentations.

5. The cylinder lock device according to claim 4, wherein each of the plurality of spacer assemblies comprises a plurality of inner spacer disks including a main inner spacer disk positioned between two auxiliary inner spacer disks; the auxiliary inner spacer disks being shaped in a way that do not have points of contact on an external periphery of the inner dial disks and the outer dial disks placed between the auxiliary inner spacer disks to avoid any possible interference between the teeth of the inner dial disks, the outer spacer rings and the second indentations of the outer dial rings when in the "decoupled" configuration.

6. The cylinder lock device according to claim 5, wherein the programming mode enable disk includes a tooth on an external surface thereof and an indentation for engaging the moving member of the key mechanism when the moving member is forced to move from a recessed position with respect to the key body that the moving member had during insertion of the key in the cylinder lock device, and further comprising an engagement element and an opening on the rotor, wherein, during the insertion of the key, the engagement element engages the moving member to force the moving member to protrude from the key body to engage the programming mode enable disk, wherein the programming mode enable disk, once engaged by the moving member, is driven by the key in the partial rotation that aligns the plurality of dial members in the "unlocked" configuration of the locking mechanism to reach a particular configuration where the tooth of the programming mode enable disk remains inside the opening on the rotor and is aligned with a portion of the opening that allows an axial translation of the programming mode enable disk.

7. The cylinder lock device according to claim 6, and further comprising a front circumferential track on a surface of the cavity of the stator, a rear circumferential track on the surface of the cavity of the stator, a longitudinal groove on the surface of the cavity of the stator that connects the front circumferential track and the rear circumferential track, wherein the particular configuration reached by the programming mode enable disk in which the tooth of the programming mode enable disk is aligned with the opening that allows the axial translation of the programming mode enable disk is a necessary first condition in order to allow the axial translation of the programming mode enable disk because the tooth of the programming mode enable disk protrudes outside an outer surface of the rotor to engage the front circumferential track on the surface of the cavity of the stator, and the tooth of the programming mode enable disk can be moved from the front circumferential track to a different axial position in the rear circumferential track, only when the tooth of the programming mode enable disk is aligned with the longitudinal groove that connects the front circumferential track and the rear circumferential track, the longitudinal groove being positioned to be reached by the tooth of the programming mode enable disk only when the locking mechanism is in the "unlocked" configuration and the rotor is rotated at a suitable angle with respect to the stator.

8. The cylinder lock device according to claim 7, wherein the longitudinal groove is the seat in the body of the stator for receiving the engagement member.

9. The cylinder lock device according to claim 7, wherein the rear circumferential track extends only for a partial portion of a circumference of the cavity of the stator body so that, after placing the locking mechanism in the "unlocked" configuration, having enabled the "programming mode enable" security mechanism and having activated the programming mechanism to reach the "decoupled" configuration by the axial displacement of the key, a rotation of the key in the direction of the "locked" configuration leaves the cylinder lock device in a stable "programming" configuration where the sub-components of the plurality of dial members are kept decoupled, the key can be extracted and substituted with the new key including the different sequence of indentations that can drive the cylinder lock device back out from the "programming" configuration after having obtained a suitable change of the configuration of each of the plurality of dial members that matches the different sequence of indentations of the new key.

10. The cylinder lock device according to claim 8 wherein the front disk includes a cavity housing a hard spherical element for resisting drilling of the cylinder lock device.

11. The cylinder lock device according to claim 1, wherein the programming mode enable disk includes a tooth on an external surface thereof and an indentation for engaging the moving member of the key mechanism when the moving member is forced to partially abandon a recessed position with respect to the key body that the moving member had during insertion of the key in the cylinder lock device, and further comprising an engagement element and an opening on the rotor, wherein, during the insertion of the key, the engagement element engages the moving member to force the moving member to protrude from the key body to engage the programming mode enable disk, wherein the at least one dial member comprises a plurality of dial members, wherein the programming mode enable disk, once engaged by the moving member, is driven by the key in a partial rotation that aligns the plurality of dial members in the "unlocked" configuration of the locking mechanism to reach a particular configuration where the tooth of the programming mode enable disk remains inside the opening on the rotor and is aligned with a portion of the opening that allows an axial translation of the programming mode enable disk.

12. The cylinder lock device according to claim 11, and further comprising a front circumferential track on a surface of the cavity of the stator, a rear circumferential track on the surface of the cavity of the stator, a longitudinal groove on the surface of the cavity of the stator that connects the front circumferential track and the rear circumferential track, wherein the particular configuration reached by the programming mode enable disk in which the tooth of the programming mode enable disk is aligned with the opening that allows the axial translation of the programming mode enable disk is a necessary first condition in order to allow the axial translation of the programming mode enable disk because the tooth of the programming mode enable disk protrudes outside an outer surface of the rotor to engage the front circumferential track on the surface of the cavity of the stator, and the tooth of the programming mode enable disk can be moved from the front circumferential track to a different axial position in the rear circumferential track, only when the tooth of the programming mode enable disk is aligned with the longitudinal groove that connects the front circumferential track and the rear circumferential track, the longitudinal groove being positioned to be reached by the tooth of the programming mode enable disk only when the locking mechanism is in the "unlocked" configuration and the rotor is rotated at a suitable angle with respect to the stator.

13. The cylinder lock device according to claim 2, wherein the programming mode enable disk includes a tooth on an external surface thereof and an indentation for engaging the moving member of the key mechanism when the moving member is forced to partially abandon a recessed position with respect to the key body that the moving member had during insertion of the key in the cylinder lock device, and further comprising an engagement element and an opening on the rotor, wherein, during the insertion of the key, the engagement element engages the moving member to force the moving member to protrude from the key body to engage the programming mode enable disk, wherein the programming mode enable disk, once engaged by the moving member, is driven by the key in the partial rotation that aligns the plurality of dial members in the "unlocked" configuration of the locking mechanism to reach a particular configuration where the tooth of the programming mode enable disk remains inside the opening on the rotor and is aligned with a portion of the opening that allows an axial translation of the programming mode enable disk.

14. The cylinder lock device according to claim 13, and further comprising a front circumferential track on a surface of the cavity of the stator, a rear circumferential track on the surface of the cavity of the stator, a longitudinal groove on the surface of the cavity of the stator that connects the front circumferential track and the rear circumferential track, wherein the particular configuration reached by the programming mode enable disk in which the tooth of the programming mode enable disk is aligned with the opening that allows the axial translation of the programming mode enable disk is a necessary first condition in order to allow the axial translation of the programming mode enable disk because the tooth of the programming mode enable disk protrudes outside an outer surface of the rotor to engage the front circumferential track on the surface of the cavity of the stator, and the tooth of the programming mode enable disk can be moved from the front circumferential track to a different axial position in the rear circumferential track, only when the tooth of the programming mode enable disk is aligned with the longitudinal groove that connects the front circumferential track and the rear circumferential track, the longitudinal groove being positioned to be reached by the tooth of the programming mode enable disk only when the locking mechanism is in the "unlocked" configuration and the rotor is rotated at a suitable angle with respect to the stator.

15. The cylinder lock device according to claim 14, wherein the rear circumferential track extends only for a partial portion of a circumference of the cavity of the stator body so that, after placing the locking mechanism in the "unlocked" configuration, having enabled the "programming mode enable" security mechanism and having activated the programming mechanism to reach the "decoupled" configuration by the axial displacement of the key, a rotation of the key in a direction of the "locked" configuration leaves the cylinder lock device in a stable "programming" configuration where the sub-components of the plurality of dial members are kept decoupled, the key can be extracted and substituted with a new key including a different sequence of indentations that can drive the cylinder lock device back out from the "programming" configuration after having obtained a suitable change of the configuration of each of the plurality of dial members that matches the different sequence of indentations of the new key.

16. The cylinder lock device according to claim 15, wherein the longitudinal groove is the seat in the body of the stator for receiving the engagement member.

17. The cylinder lock device according to claim 4, wherein the front disk includes a cavity housing a hard spherical element for resisting drilling of the cylinder lock device.

* * * * *